US006314849B1

(12) United States Patent
Arrasmith

(10) Patent No.: US 6,314,849 B1
(45) **Date of Patent: *Nov. 13, 2001**

(54) DICING MACHINE WITH IMPROVED CUTTING SQUARENESS

(75) Inventor: Paul Earl Arrasmith, Valparaiso, IN (US)

(73) Assignee: Urschel Laboratories Inc., Valpariso, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/934,381

(22) Filed: Sep. 19, 1997

(51) Int. Cl.[7] ..... B26D 7/00

(52) U.S. Cl. ..... 83/145; 83/166; 83/167; 83/408; 83/932; 241/166; 241/167

(58) Field of Search ..... 83/121, 122, 124, 83/408, 698.51; 241/166, 167

(56) References Cited

U.S. PATENT DOCUMENTS

| | | | | |
|---|---|---|---|---|
| 2,242,557 | | 5/1941 | Urschel et al. . | |
| 2,349,212 | | 5/1944 | Urschel et al. . | |
| 2,436,410 | | 2/1948 | Urschel et al. . | |
| 2,541,180 | | 2/1951 | Urschel et al. . | |
| 2,603,262 | | 7/1952 | Urschel et al. . | |
| 2,934,117 | | 4/1960 | Urschel et al. . | |
| 3,053,296 | | 9/1962 | Urschel et al. . | |
| 3,598,163 | | 8/1971 | Urschel et al. . | |
| 3,654,978 | * | 4/1972 | Gabel | 83/122 |
| 3,857,310 | * | 12/1974 | Tiby | 83/26 |
| 4,391,172 | * | 7/1983 | Galland et al. | 83/403 |
| 4,625,606 | * | 12/1986 | Pinegar et al. | 83/403 |
| 4,782,729 | * | 11/1988 | Mathot | 83/408 |
| 5,129,299 | | 7/1992 | Fischer et al. . | |
| 5,410,954 | * | 5/1995 | Wygal et al. | 99/537 |
| 5,423,250 | * | 6/1995 | Anderson et al. | 99/537 |
| 5,482,166 | * | 1/1996 | Brown | 83/408 X |
| 5,694,824 | * | 12/1997 | Jacko et al. | 83/403 |
| 5,722,143 | * | 3/1998 | Bucks et al. | 29/281.5 |
| 5,784,937 | * | 7/1998 | Wygal et al. | 83/422 |

* cited by examiner

*Primary Examiner*—M. Rachuba
(74) *Attorney, Agent, or Firm*—Bacon & Thomas, PLLC

(57) ABSTRACT

An apparatus for cutting a food product is disclosed including a stationary structure with a food product guide surface for guiding a food product along a path of travel, the apparatus having a knife wheel rotatable about a knife wheel axis, the knife wheel having at least one knife blade and located such that rotation of the knife wheel about the knife wheel axis causes the knife blade to cut through the food product as it moves along the path of travel. The apparatus also includes a knife wheel support which rotatably supports the knife wheel, the knife wheel support being pivotally attached to the stationary structure so as to pivot about a pivot axis extending substantially parallel to the knife wheel axis, such that the knife wheel axis is movable along an arcuate path about the pivot axis. By readily positioning the knife wheel in one of a plurality of discrete positions along the arcuate path, a visually acceptable square diced food product may be obtained from food products having a variety of thicknesses. The apparatus also includes a plurality of adjustable stripper plates extending between adjacent ones of a plurality of circular knives which slice the food product into a plurality of strips prior to the food product being cut by the cross-cut knife wheel. The stripper plates have an adjustable attaching mechanism connecting them to the stationary structure to facilitate the adjustment of the distance between the stripper plates and the food guide surface so as to readily accommodate a food product having a variety of thicknesses.

13 Claims, 5 Drawing Sheets

DICING MACHINE WITH IMPROVED CUTTING SQUARENESS

BACKGROUND OF THE INVENTION

The present invention generally involves a field of technology pertaining to apparatus for cutting and dicing food products into discrete particles of predetermined shape and size. More particularly, the invention relates to a dicing machine having features to improve the squareness of cubed pieces cut from the food product.

Devices for cutting food products into smaller, discrete portions through a series of cutting operations are well-known in the art. Such machines are particularly suited for cutting food products into discrete pieces having substantially rectangular or cubical configurations. Generally, this is accomplished by conveying the food product over a slicing knife which severs a relatively thin slice of the food product, conveying the food product slice through a rotating bank of circular knives which cut the sliced food product into a plurality of elongated strips and thereafter directing these strips into a cross-cut knife assembly wherein a rotating bank of elongated knives cut the food product transversely into diced sections having either a rectangular or cubical configuration. The bank of circular knives may be associated with a stationary stripper plate having fingers extending between adjacent circular knives to prevent the food product from adhering to the circular knives as they rotate.

An important factor in a customer's selection of a cutting or dicing machine is the visual appearance of the cut food product produced by the machine. The squareness of the sides of the cubed material plays an important part in the overall appearance. Obtaining a square cut (one in which the sides of the cubed food product are perpendicular to adjacent sides, as well as to the top and bottom of the cube) using a circular shaped cross-cut spindle is difficult to achieve utilizing the known apparatus. Typically, such apparatus utilizes a rotating cross-cut spindle having a plurality of knives extending from a periphery of the spindle. As the spindle rotates, the knives sequentially contact and cut the moving food product, which may have been previously cut into a plurality of strips. The cross-cut knives transversely cut the product strips into a cubed food product.

In the prior machines, the position of the cross-cut spindle relative to a shear edge, which interacts with the cross-cut knives to cut the food product, is not easily adjustable. Thus, while the known machines may be set to provide a cubed food product having satisfactory squareness for a given thickness of the food product slice, any variation in this food product slice thickness will cause the cubed end product to be unacceptably out of "square". In order to achieve an optimum squareness of cut, the cross-cut knife must enter the top of the continuously moving food slice and progress through the food product at the proper speed and angle past the shear edge. The size and squareness of the cut by the cross-cut knives are determined by the diameter of the circular path traveled by the cutting edges of the cross-cut knives, the number of knives on the cross-cut spindle, the angular location of the cross-cut spindle center relative to the shear edge, and the timing relationship between the speed of the sliced food product and the rotational speed of the cross-cut spindle. The cross-cut knives must be able to make the cuts without impeding the movement of the sliced food product, or accelerating the food product slice which is typically traveling at the speed of the circular knives. Typically, the timing and the angular location of the cross-cut spindle are set to achieve the optimum squareness of cut for given thickness of sliced food product. As the thickness of the food product becomes thicker or thinner than that for which the machine is set, the slice squareness gets progressively worse. Due to these difficulties with known dicing apparatus, it can be seen that a need exists for a dicing machine having the ability to provide square cut cubed food products from food product slices having a variety of thicknesses.

SUMMARY OF THE INVENTION

An apparatus for cutting a food product is disclosed including a stationary structure with a food product guide surface for guiding a food product along a path of travel, the apparatus having a knife wheel rotatable about a knife wheel axis, the knife wheel having at least one knife blade and located such that rotation of the knife wheel about the knife wheel axis causes the knife blade to cut through the food product as it moves along the path of travel. The apparatus also includes a knife wheel support which rotatably supports the knife wheel, the knife wheel support being pivotally attached to the stationary structure so as to pivot about a pivot axis extending substantially parallel to the knife wheel axis, such that the knife wheel axis is movable along an arcuate path about the pivot axis. By readily positioning the knife wheel in one of a plurality of discrete positions along the arcuate path, a visually acceptable square diced food product may be obtained from food products having a variety of thicknesses. The apparatus also includes a plurality of adjustable stripper plates extending between adjacent ones of a plurality of circular knives which slice the food product into a plurality of strips prior to the food product being cut by the cross-cut knife wheel. The stripper plates have an adjustable attaching mechanism connecting them to the stationary structure to facilitate the adjustment of the distance between the stripper plates and the food guide surface so as to readily accommodate a food product having a variety of thicknesses.

The positions of the stripper plates are readily adjusted to accommodate the thickness of the food product being cut to insure that the food product remains on the food product guide surface and does not adhere to the circular knives. The knife wheel support extends between side plates located on either side of the path of travel of food product and is readily affixed in one of a plurality of positions by holes formed in the knife wheel support and corresponding holes formed in the side plates. The insertion of a bolt, pin, or the like through the aligned holes will securely affix the knife wheel support in the desired position to achieve the optimum cut squareness.

BRIEF DESCRIPTIONS OF THE DRAWINGS

DETAILED DESCRIPTION OF THE PREFERRED EMBODIMENT

Figure 1:
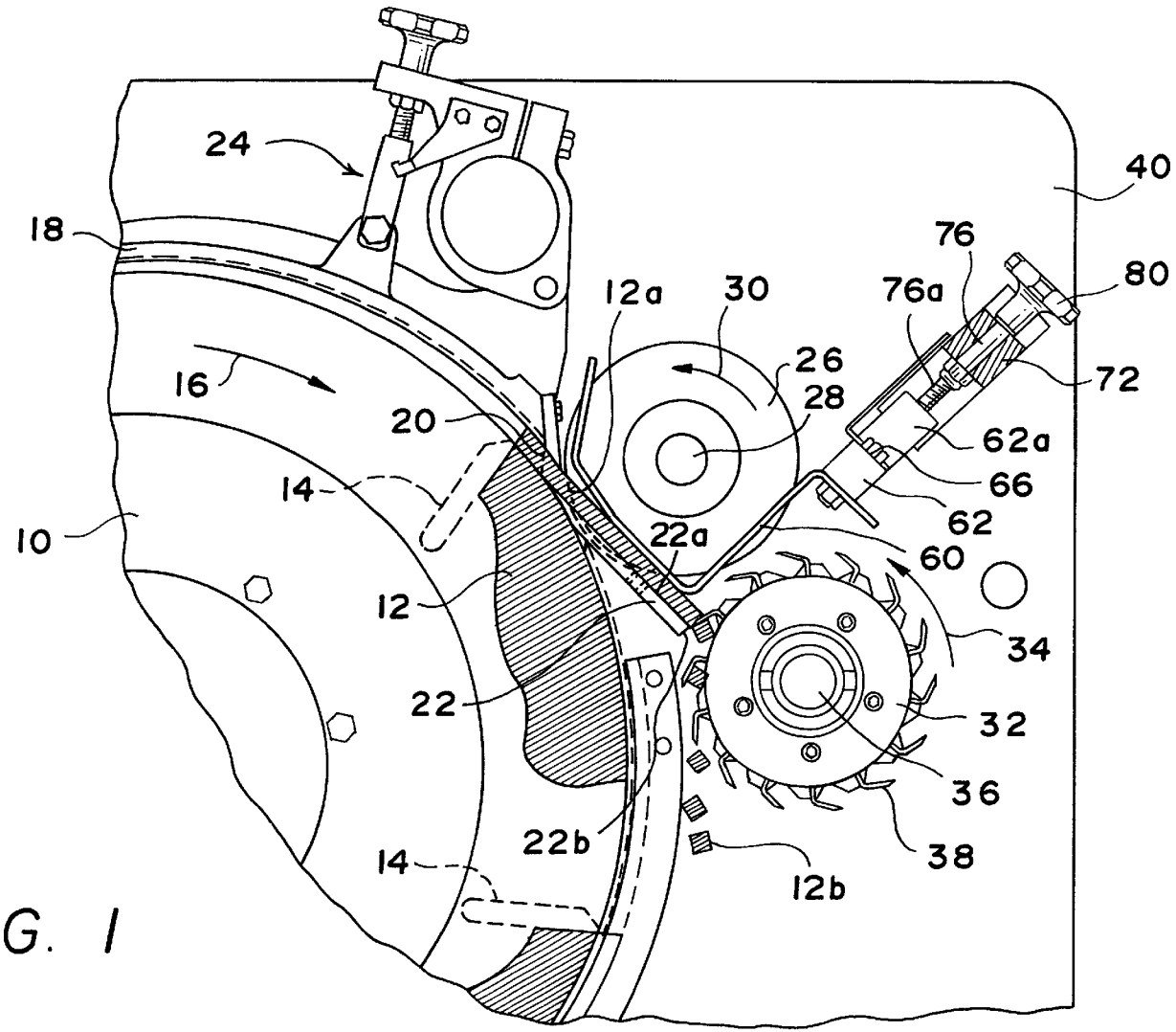
FIG. 1 is a partial, cross-sectional view of the apparatus according to the present invention.

The apparatus according to the present invention, as best illustrated in FIG. 1, has a rotatable drum 10 into which food products 12 are placed, the drum 10 having a plurality of generally radially orientated pusher vanes 14 mounted therein such that rotation of the drum 10 in the direction of arrow 16 causes the food product 12 to be urged by centrifugal force against the inner periphery of stationary cylinder 18 located around the outer periphery of the drum 10. An opening 20 is formed in the stationary cylinder 18 and a slicing knife 22 is attached to the stationary cylinder 18 such that the cutting edge of the slicing knife extends through the gap and into the space bounded by the stationary cylinder 18. As the pusher vanes 14 push the food product 12 against the cutting edge 20 of the slicing knife 22, a predetermined thickness of food product 12*a* is cut from the food product 12 and passes over the food product guide surface 22*a,* in this case formed on the outer surface of the slicing knife 22. Guide surface 22*a* terminates at shear edge 22*b*, to be further described below. Shear edge 22*b* extends transversely relative to the direction of motion of sliced food products. A known mechanism 24 is utilized to adjust the dimensions of the opening 20 which, in turn, adjusts the thickness of the sliced food product 12*a.*

The apparatus may also include a plurality of circular knives 26 rotatably mounted on a common axle 28 such that all of the knives 26 are rotated simultaneously in the direction of arrow 30. As can be seen, the plurality of circular knives 26 are located such that these knives cut the sliced food product 12*a* into a plurality of elongated strips as the sliced food product 12*a* travels along the food product guide surface 22*a.*

After being sliced into a plurality of elongated strips, the sliced food product 12*a* encounters a cross-cut knife wheel 32 which rotates in the direction of arrow 34 about axle 36. Cross-cut knife wheel 32 has a plurality of cross-cut knife blades 38 extending from the periphery, each cross-cut knife blade having a cutting edge. The cutting edges of the knife blades 38 interact with shear edge 22*b,* in this particular instance formed by a transverse end of slicing knife 22, to transversely cut the elongated sliced food product 12*a* so as to form cubed food products 12*b.* However, it is to be understood that the shear edge 22*b* may be formed as part of the stationary structure of the apparatus and need not be associated with the slicing knife 22.

The stationary structure of the apparatus also includes side plates 40 located on opposite lateral sides of the path of travel of the food product and to which the axle 28 may be affixed to rotatably support the circular cutting knives 26.

Figure 2:
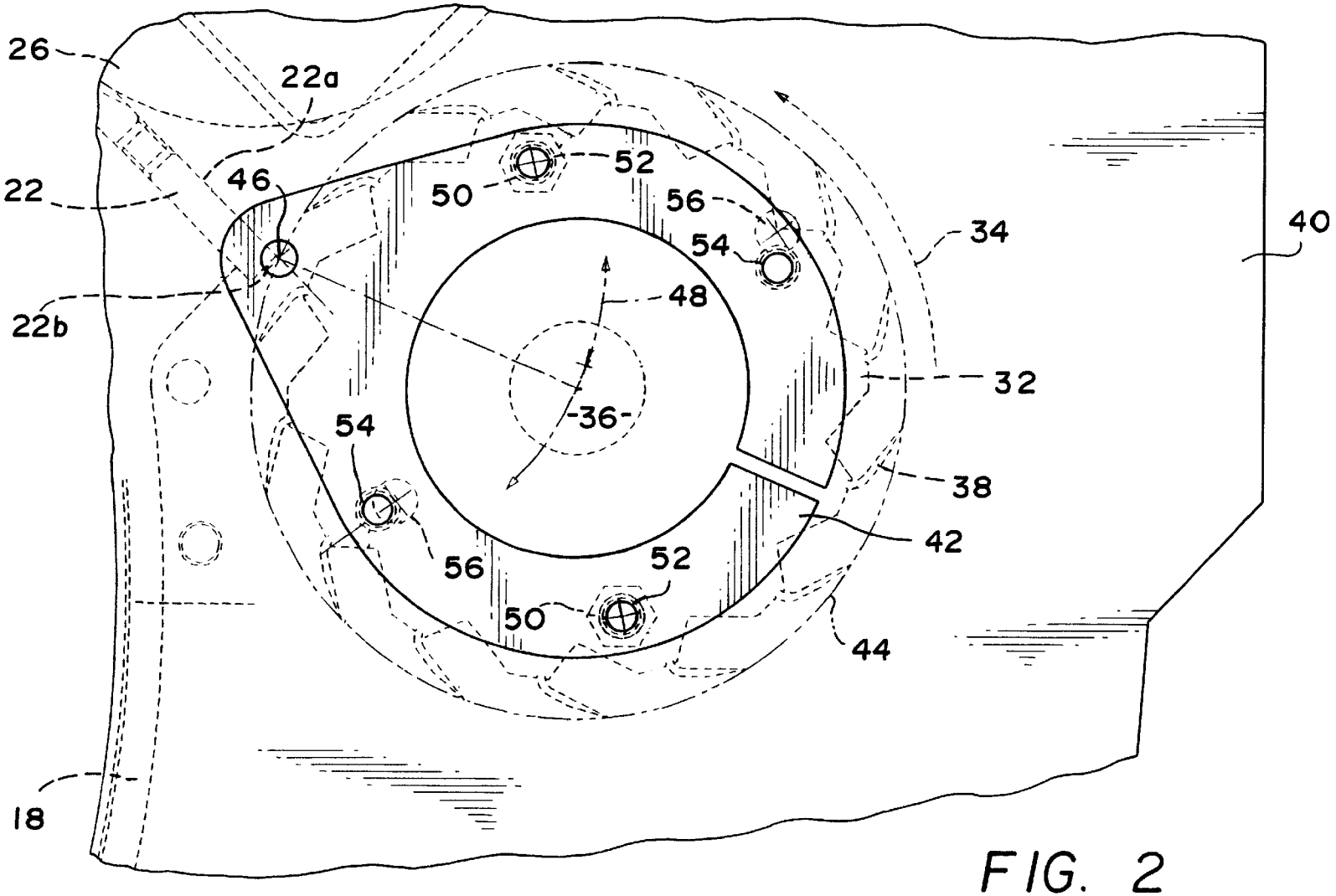
FIG. 2 is a partial, side view illustrating the knife wheel support mounting system according to the present invention.

The novel mounting of the cross-cut knife wheel is best illustrated in FIG. 2. A cross-cut knife wheel support 42 rotatably supports the axle 36 thereon, such knife wheel supports being located at opposite ends of the cross-cut knife wheel 32. The knife wheel supports 42 rotatably support the cross-cut knife wheel 32 therein such that the cutting edges of the cross-cut knives 38 traverse a circular path of travel 44. As noted previously, the cutting edges of the cross-cut knives 38 traverse the shear edge 22*b* with a cutting clearance and interact with the shear edge 22*b* to transversely cut the food product.

Each of the knife wheel supports 42 are pivotally attached to the stationary structure of the machine, for instance the side plates 40, such that the knife wheel supports 42, along with the entire cross-cut knife wheel 32 may pivot about a pivot axis 46 extending substantially parallel to the rotational axis of the cross-cut knife wheel 32. The location of the knife wheel support pivot axis 46 is at the intersection of a line extending along the food product guide surface 22*a* and the circular path of travel 44 of the cutting edges of cross-cut knives 38. This intersection is illustrated at 46 in FIG. 2. By pivotally attaching the knife wheel supports 42 to the stationary structure of the apparatus, the center of the rotatable cross-cut knife wheel 32 may be moved along arcuate path 48. Such movement will adjust the positions of the cutting edges of the cross-cut knives 38 relative to the shear edge 22*b* without varying the cutting clearance between the knives and the shear edge such that food products having a variety of thicknesses may be diced into cubical pieces having improved squareness of cut. The position adjustment, as evident from FIG. 2, permits adjustment of the angle at which the knives 38 approach the shear edge 22*b* to ensure a desired squareness of cut for various slice thicknesses.

The knife wheel supports 42 may be affixed in one of a plurality of discrete positions by first position holes 50 formed in the knife wheel support 42 and second position holes 52 formed in the stationary structure of the apparatus, in this particular instance, in side plates 40. Third position holes 54 may be formed in the knife wheel support 42 and fourth position holes 56 formed in the side plates 40. The cross-cut cutting wheel 32 is properly oriented for a sliced food product having a first thickness by aligning first position holes 50 with the second position holes 52 and inserting a bolt, pin, or the like through the aligned holes to hold the knife wheel support in the desired position relative to the stationary side plates 40. Adjustment of the position of the cross-cut knife wheel 32 may be accomplished by removing the bolts, pins or the like from aligned holes 50 and 52, and moving the knife wheel supports 42 such that third position holes 54 are aligned with fourth position holes 56 and reinserting the bolts, pins, or the like. Although the invention has been described and illustrated having two discrete adjustment positions, it is to be understood that more than two such positions may be easily accommodated depending upon the particular usage of the cutting apparatus, without exceeding the scope of this invention.

Figure 3:
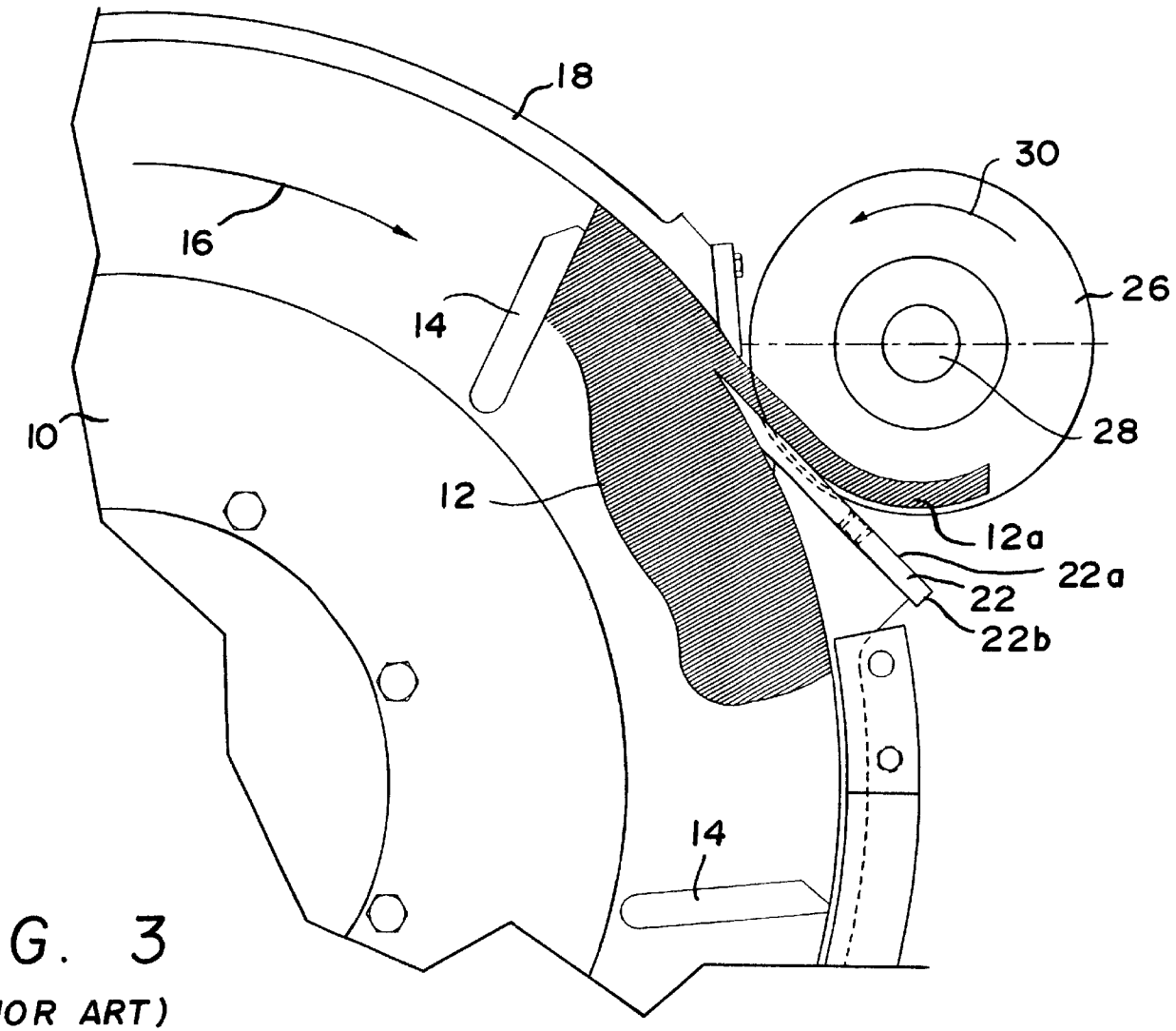
FIG. 3 (PRIOR ART)
FIG. 3 is a schematic diagram of the prior art cutting apparatus illustrating the sliced food product adhering to the circular cutting knives.
Figure 4:
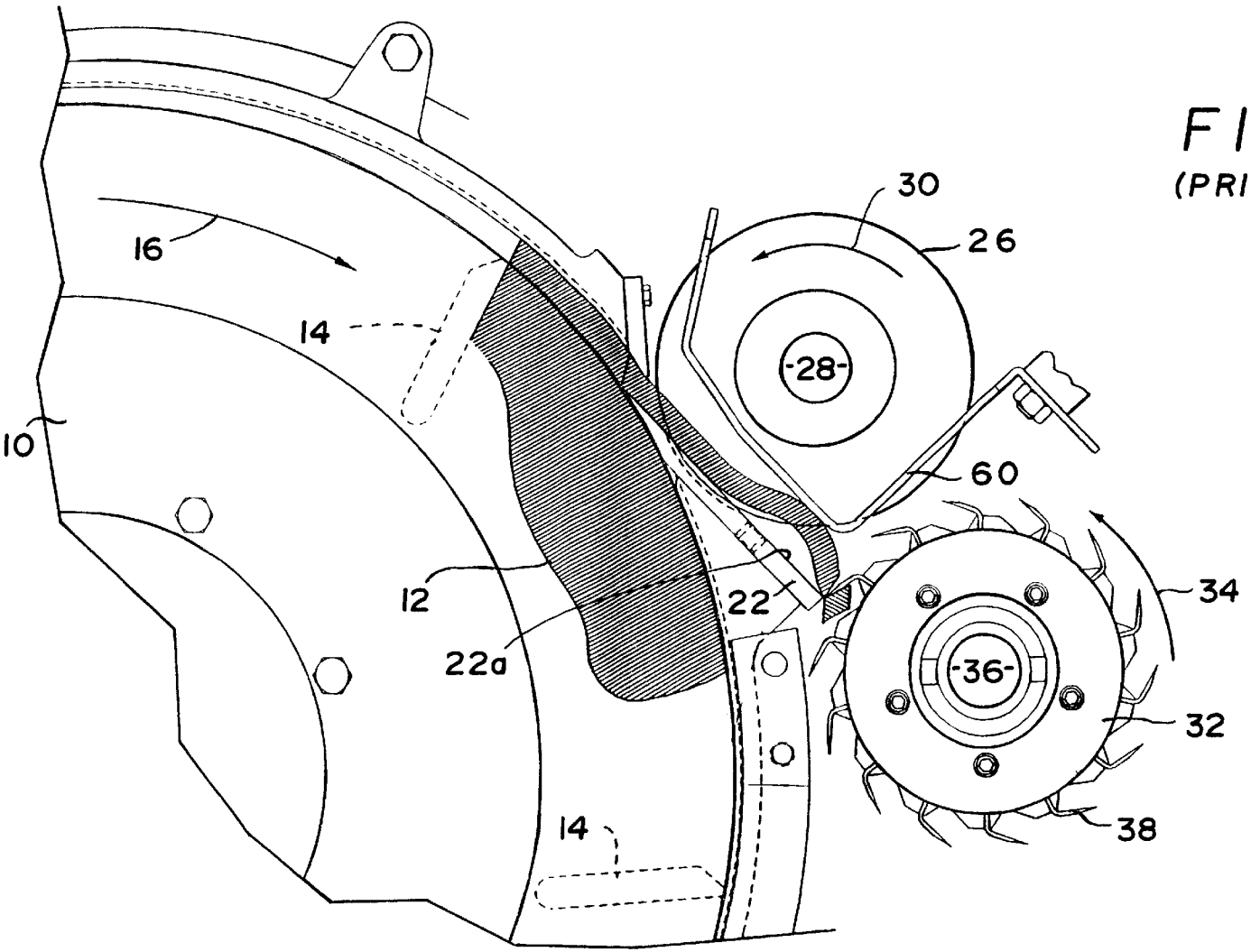
FIG. 4 (PRIOR ART)
FIG. 4 is a partial, cross-sectional view of a prior art apparatus illustrating a fixed stripper plate used with a sliced food product too thin to achieve the optimum squareness of cut.

Another problem affecting the prior art apparatus, as illustrated in FIGS. 3 and 4, is the tendency of the sliced food product 12*a* to adhere to the cutting surfaces of the circular cutting knives 26. Such a tendency will cause the sliced food product 12*a* to be pulled from the food product guide surface 22*a* as best seen in FIG. 3. Quite obviously, any such tendency will prevent the diced food product from having a square cut by the cross-cut knife wheel.

The use of fixed stripper plates extending between adjacent ones of the plurality of circular cutting knifes 26 is known in the art and is illustrated in FIG. 4. The stripper plates 60 are typically affixed to the stationary structure of the apparatus and are optimally positioned for a given thickness of sliced food product. If the apparatus is adjusted to produce a thinner than optimal thickness of sliced food product, the sliced food product will tend to adhere to the plurality of circular cutting knives 26 before coming into contact with the stripper plate 60. Thus, sliced food product will still be removed from the food product guide surface 22*a,* prior to contact with the cross-cut knives 38, thereby rendering it impossible to produce a square cut diced food product.

Figure 5:
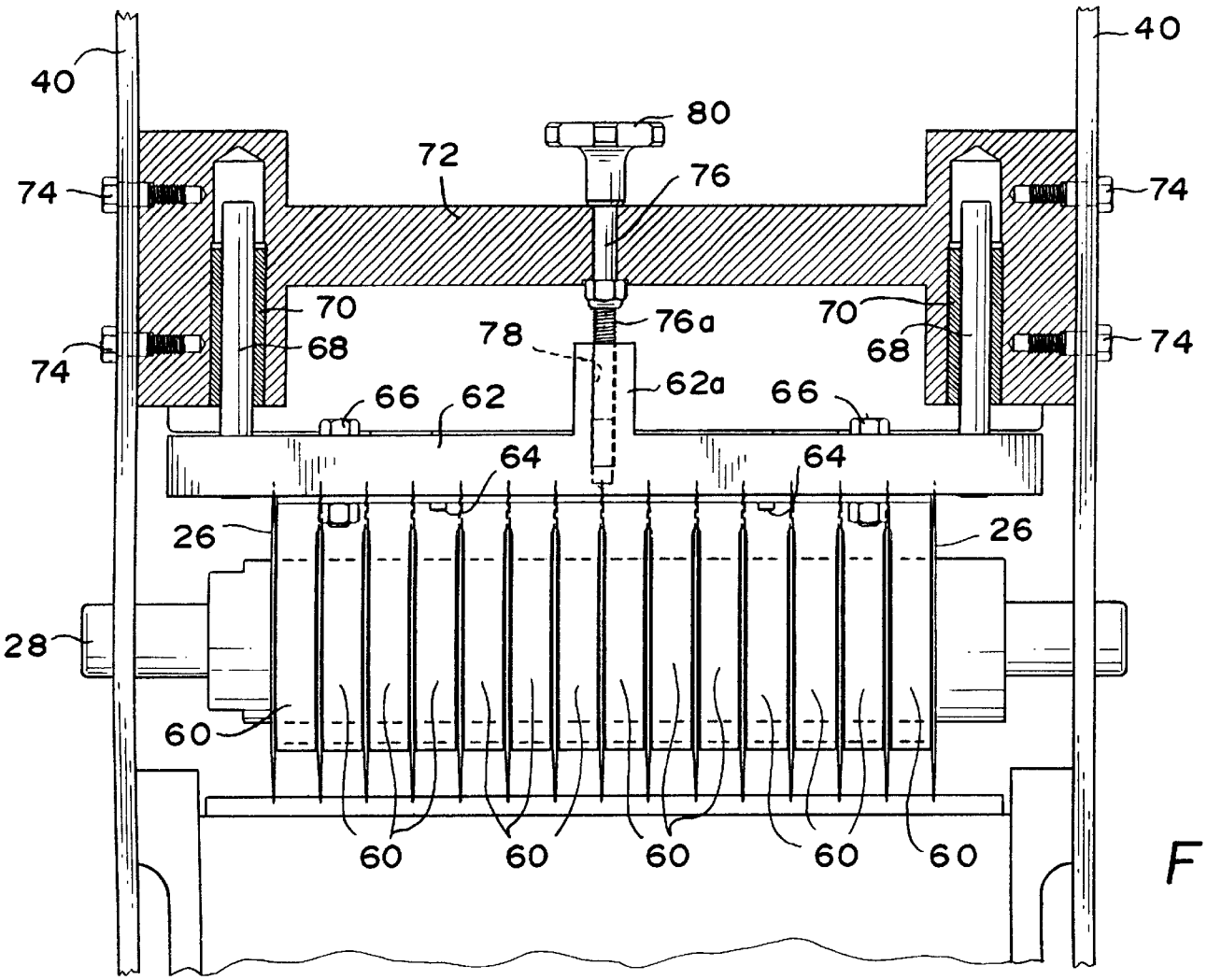
FIG. 5 is a front view, partially in cross-section, illustrating the stripper plate adjusting mechanism according to the present invention.

Applicant has overcome this problem of the prior art devices by providing an adjustable stripper plate mechanism as illustrated in FIGS. 1 and 5. As in the prior art devices, the present invention includes a plurality of stripper plates 60 extending between adjacent pairs of the circular cutting knives 26 to prevent the sliced food product 12*a* from being drawn away from the food product guide surface 22*a* by the circular cutting knives 26. The plurality of stripper plates 60 extend from an adjustment bar 62 and are located by dowl pins 64 and attached to the adjustment bar by fasteners 66. Guide pins 68 extend upwardly from the adjustment bar 62 and each are slidably received in bushings 70 fixedly attached to an adjustment mount 72. As can be seen, the adjustment mount 72 is fixedly attached to the opposite side plates 40 by fasteners 74.

Shaft 76 is rotatably mounted on the adjustment mount 72 and has a threaded end portion 76*a* which threadingly engages an internally threaded hole 78 formed in a boss 62*a* which extends upwardly from the adjustment bar 62. A stripper adjustment knob 80 is attached to the end of shaft 76 such that rotation of knob 80 also causes rotation of the shaft 76.

It is evident that the distance between the stripper plates 60 and the food product guide surface 22*a* maybe easily be adjusted by the rotation of stripper adjustment knob 80. Such rotation causes rotation of the shaft 76 relative to the threaded boss 62*a,* such relative rotation resulting in the longitudinal movement of adjustment bar 62 relative to the adjustment mount 72. Thus, the stripper plates 60 can be properly positioned for virtually any thickness of sliced food product to insure that the sliced food product 12*a* follows the food product guide surface 22*a* and is not withdrawn by its tendency to adhere to the circular cutting knives 26.

The foregoing description is provided for illustrative purposes only and should not be construed as in any way limited this invention, the scope of which is defined solely by the appended claims.

I claim:

1. Apparatus for cutting a food product including a stationary structure with a food product guide surface terminating at a transversely extending shear edge, the apparatus comprising:

a) a knife wheel rotatable about a knife wheel axis, the knife wheel having at least one knife blade extending parallel to the shear edge and the wheel axis and located such that rotation of the knife wheel about the knife wheel axis causes the at least one knife blade to be moved in a circular path of travel and transversely about the wheel axis to cut through a food product delivered to the knife wheel at the shear edge, the at least one knife blade traversing said shear edge with a cutting clearance and at a cutting angle, b) a knife wheel support rotatably supporting the knife wheel, the knife wheel support pivotally attached to the stationary structure so as to pivot about a pivot axis spaced away from and extending substantially parallel to the knife wheel axis and in alignment with the shear edge so that the knife wheel axis is movable along an arcuate path about the pivot axis without varying said cutting clearance, but varying said cutting angle.

2. The apparatus of claim 1 further comprising a releasable connection between the knife wheel support and the stationary structure arranged so that the knife wheel and knife wheel support are releasably affixed at a pivoted position relative to the pivot axis in one of a plurality of discrete positions relative to the stationary structure.

3. The apparatus of claim 2 wherein the stationary structure includes at least one side plate located adjacent to the knife wheel support and wherein the releasable connection comprises:

a) first and second position holes in the knife wheel support;

b) third and fourth position holes in the at least one side plate located such that when the knife wheel is in a first desired position the first and third position holes are aligned, and when the knife wheel is in a second desired position, the second and fourth position holes are aligned; and, c) a fastener inserted into the aligned position holes to releasably hold the knife blade wheel in the desired position.

4. The apparatus of claim 3 wherein the position holes in at least one of the knife wheel support and the at least one side plate are threaded, and wherein the fastener comprises a bolt threaded into one of the threaded position holes.

5. The apparatus of claim 1 wherein the knife wheel comprises a plurality of knife blades.

6. The apparatus of claim 1 including a plurality of spaced apart circular knives rotatable about a common circular knife axis and further comprising:

a) a plurality of stripper plates, including individual stripper plates extending between adjacent pairs of spaced apart circular knives; and, b) an adjustable mounting device attaching the plurality of stripper plates to the stationary structure such that the distance between the plurality of stripper plates and the food product guide surface is adjustable to accommodate food products of differing thicknesses.

7. The apparatus of claim 6 wherein the adjustable mounting device includes a stripper adjustment knob arranged so that rotation of the adjustment knob varies the distance between the plurality of stripper plates and the food product guide surface.

8. The apparatus of claim 6 wherein the adjustable mounting device comprises:

a) an adjustment mount affixed to the stationary structure;

b) an adjustment bar from which the plurality of stripper plates extend, the adjustment bar slidably connected to the adjustment mount; and, c) an adjuster connected to the adjustment mount and the adjustment bar so as to move the adjustment bar relative to the adjustment mount.

9. The apparatus of claim 8 wherein the adjustor comprises:

a) a threaded portion formed on the adjustment bar; and, b) a shaft rotatably mounted on the adjustment mount, the shaft having a threaded shaft portion engaging the threaded portion of the adjustment bar such that rotation of the shaft causes the adjustment bar to move relative to the adjustment mount.

10. The apparatus of claim 9 wherein said stripper adjustment knob is attached to said shaft.

11. The apparatus of claim 8 further comprising:

a) at least one guide pin extending from one of the adjustment mount and the adjustment bar; and, b) at least one guide bushing located on the other of the adjustment mount and the adjustment bar, and configured to slidably receive the at least one guide pin therein.

12. The apparatus of claim 8 further comprising at least one fastener to removably attach the plurality of stripper plates to the adjustment bar.

13. The apparatus of claim 8 wherein the stationary structure includes a pair of spaced apart side plates located on opposite sides of the food product guide surface, and wherein the adjustment mount is attached to and extends between the spaced apart side plates.

* * * * *